United States Patent [19]

Takano

[11] Patent Number: 4,470,470

[45] Date of Patent: Sep. 11, 1984

[54] BORING APPARATUS

[75] Inventor: Sho Takano, Narita, Japan

[73] Assignee: Sumitomo Metal Mining Company Limited, Tokyo, Japan

[21] Appl. No.: 419,192

[22] Filed: Sep. 17, 1982

[30] Foreign Application Priority Data

Sep. 17, 1981 [JP] Japan ..... 56-146516
Dec. 28, 1981 [JP] Japan ..... 56-211656

[51] Int. Cl.[3] ..... E21B 10/64
[52] U.S. Cl. ..... 175/260; 175/261
[58] Field of Search ..... 175/260, 261, 258, 331, 175/333, 263, 269, 291

[56] References Cited

U.S. PATENT DOCUMENTS

| | | | |
|---|---|---|---|
| 2,873,093 | 2/1959 | Hildebrandt et al. | 175/333 |
| 3,074,494 | 1/1963 | Kammerer | 175/260 |
| 3,554,304 | 1/1971 | Link et al. | 175/260 X |
| 3,656,564 | 4/1972 | Brown | 175/261 X |
| 3,894,590 | 7/1975 | Takano et al. | 175/107 |

*Primary Examiner*—James A. Leppink
*Assistant Examiner*—Thuy M. Bui
*Attorney, Agent, or Firm*—Watson, Cole, Grindle & Watson

[57] ABSTRACT

A boring apparatus comprises a drill pipe for being placed underground, an outer tube insertable into the drill pipe, and an inner tube axially movably inserted in the outer tube. The inner tube is locked against relative movement with respect to the drill pipe while being allowed to rotate therewith when locking members mounted on the inner tube partly project through locking member control windows in the outer tube into recesses defined in an inner surface of the drill pipe. An inner cutter and outer cutters mounted on a lower end of the inner tube can project beyond a lower end of the drill pipe, with the lowermost ends of the outer cutters being held in a projecting position radially outwardly of a circumferential surface of the drill pipe. When so positioned, the outer cutters are disposed more underground i.e., axially further away from the lower end of the drill pipe, than the inner cutter. The outer tube includes arcuate water stops and the inner tube includes engagement members which cooperate such that water can flow between the outer tube and the drill pipe when the inner and outer tubes are lifted upwardly with respect to the drill pipe.

7 Claims, 4 Drawing Figures

BORING APPARATUS

BACKGROUND OF THE INVENTION

1. Field of the invention

The present invention relates to a boring apparatus for use in drilling deep wells, i.e., wells for recovering petroleum deposits or for tapping underground water sources or for use in civil construction work. More particularly, the present invention relates to a boring apparatus in which a cutter holder with an attached inner cutter is moved by water under pressure through a drill pipe toward the lower end of the drill pipe located in the ground, wherein the cutter holder is locked by a locking device on the lower end of the drill pipe, and wherein the drill pipe is rotated and pushed into the ground while rotating the cutter holder so as to enable an inner cutter and outer cutters mounted on the cutter holder to drill an underground hole having a diameter larger than the outside diameter of the drill pipe.

2. Description of the Prior Art

Boring apparatus of the type described have reamer cutters for enlarging an underground hole as drilled by a cutting bit to a size larger than the outside diameter of a drill pipe so that the drill pipe can be advanced through the hole as the hole is drilled. U.S. Pat. No. 3,894,590 discloses a boring apparatus having reamer cutters disposed closer to a ground surface than the bit located centrally in the underground hole being formed function to enlarge the hole.

The present inventor has found that the peripheral speed of a boring apparatus is larger at a position radially away from a center of rotation than at such a center of rotation, and boring can be performed more efficiently than heretofore by cutting the outer circumferential portion of a cylindrical hole with outer cutters in advance of a bit which cuts off a central portion of the cylindrical hole. For such boring operation, it is necessary that the outer cutters be positioned further underground than the bit on the cutter holder.

The outer cutters mounted on the cutter holder should be accommodatable within the drill pipe so that the cutter holder can be freely moved through the drill pipe. With the boring apparatus disclosed in U.S. Pat. No. 3,894,590, however, the outer cutters are located closer to the ground surface that the bit, and hence the cutter holder is required to have housing regions for accommodating therein the outer cutters. Since such housing regions are defined in a portion of a shank to which the bit is secured, this means that this portion of the shank has a reduced sectional area and is mechanically weak. To provide the shank with a required degree of mechanical strength, the size of the outer cutter used is limited, and the cutting efficiency of the outer cutters cannot be increased.

According to the boring apparatus described in U.S. Pat. No. 3,894,590, water is introduced into the drill pipe and supplied through the cutter holder toward the bit and outer cutters to cool the bit and outer cutters, and ground rocks cut by the bit and outer cutters are discharged with the water up along the outer surface of the drill pipe toward the ground surface. For effectively supplying water to the cutting edges of the bit and outer cutters, the prior boring apparatus has an annular packing extending around the cutter holder and pressed against an annular step defined on an inner surface of the drill pipe so that water will be supplied from within the drill pipe into and through the cutter holder to the bit, and no water will pass between the cutter holder and the drill pipe toward the lower end of the drill pipe. When the cutter holder is to be lifted through the drill pipe toward the ground surface, a mass of water filled in the drill pipe acts as a large load on the annular packing, resulting in difficulty in smoothly lifting the cutter holder through the drill pipe.

SUMMARY OF THE INVENTION

It is an object of the present invention to provide a boring apparatus which will eliminate the foregoing prior art shortcomings.

Another object of the present invention is to provide a boring apparatus in which the outer cutters are disposed more underground that an inner cutter and in which a sufficient space for accommodating the outer cutters which are of a larger size for a greater cutting efficiency than conventional boring apparatus is provided for, the inner cutter being supported by a shank having a large cross-sectional area and an increased degree of mechanical strength, i.e., since it will require no housing regions for the outer cutters.

Still another object of the present invention is to provide a boring apparatus having engagement members serving as portions of an annular water stop assembly for allowing a cutter holder to be lifted easily from the lower end of a drill pipe, reliably preventing water from passing between the cutter holder and the drill pipe as they are in the locked position, and protecting the cutter holder against dropping out of the lower end of the drill pipe.

According to the present invention, a boring apparatus comprises a drill pipe for being placed underground, an outer tube insertable into the drill pipe, and an inner tube axially movably inserted in the outer tube. The inner tube is locked against relative movement with respect to the drill pipe while being allowed to rotate therewith when locking members mounted on the inner tube partly project through locking member control windows in the outer tube into recesses defined in an inner surface of the drill pipe. An inner cutter and outer cutters mounted on a lower end of the inner tube can project beyond a lower end of the drill pipe with the lowermost ends of the outer cutters being held in a projecting position radially outwardly of a circumferential surface of the drill pipe. The outer cutters are disposed further underground i.e., axially further from the lower end of the drill pipe, than the inner cutter. Arcuate water stops are nonrotatably mounted on an upper end portion of the outer tube and have radially outward arcuate surfaces lying radially outwardly of an outer circumference of the outer tube. The outer tube has on an upper end thereof a water inlet port communicating with the interior of the inner tube, and water passage holes extending between a position between the water stops toward the lower end of the outer tube. There are engagement members nonrotatably mounted on the inner tube and projecting through the water passage holes radially outwardly of the outer circumference of the outer tube, the engagement members and the water stops being combinable into an annular body. The drill pipe has on an inner surface thereof an annular step directed toward the ground surface and engageable with the annular body when the locking members are engaged in the recesses, respectively. The boring apparatus can drill underground holes more efficiently and is simpler in construction than conventional boring apparatus.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
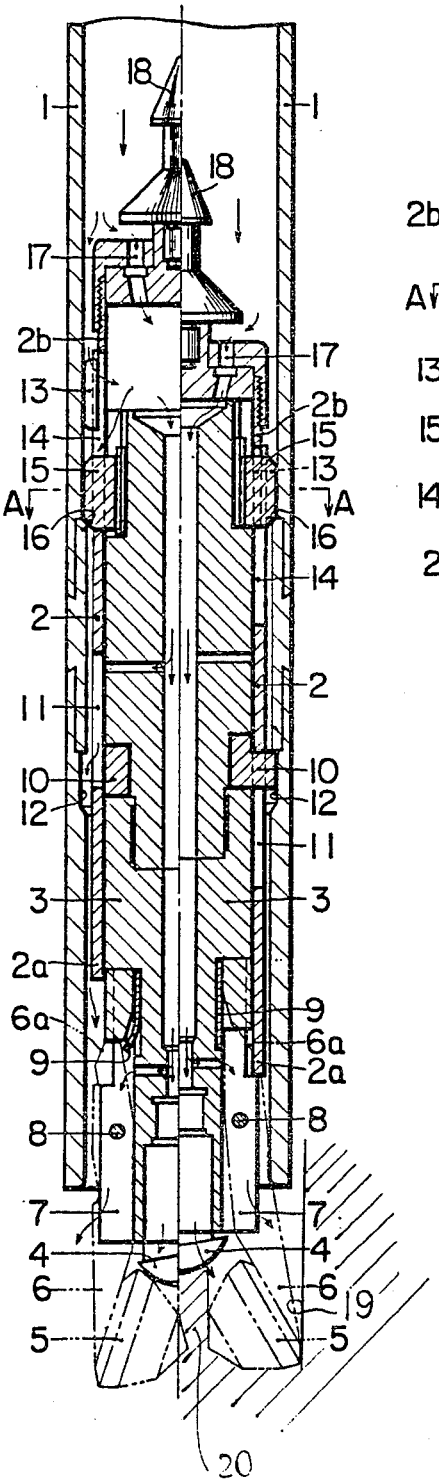
FIG. 1 is a longitudinal cross-sectional view of a boring apparatus according to the present invention, the view showing in its right half an inner tube locked on a drill pipe and in its left half the inner tube unlocked from the drill pipe.

FIG. 1 illustrates a boring apparatus according to the present invention, the view showing in its right half a cutter holder locked on a drill pipe and in its left half of cutter holder unlocked from the drill pipe.

The boring apparatus generally comprises a drill pipe 1, an outer tube 2, and an inner tube 3. The outer tube 2 has an outside diameter such that the outer tube 2 is insertable in the drill pipe 1. The inner tube 3 is axially movably disposed in the outer tube 2. An inner cutter 4 and outer cutters 5 are mounted on a lower end (lower end in FIG. 1) of the inner tube 3. The inner tube 3 and the outer tube 2 structurally serve jointly as a cutter holder. The inner cutter 4 is attached centrally to the lower end of the inner tube 3, and the outer cutters 5 are attached by support bars 6 to the lower end of the inner tube 3 and project further than the inner cutter 4 to the underground side. The support bars 6 with outer cutters 5 mounted on their lowermost ends have the their other ends fitted in slots 7 defined in the outer periphery of the lower end of the inner tube 3. The support bars are angularly spaced 120° from each other. The ends of the support bars 6 disposed in the slots 7, respectively, are attached to the inner tube 3 by pins 8 extending in directions normal to diametrical directions of the inner tube 3. Therefore, the support bars 6 are angularly movable about the pins 8 in planes parallel to the diametrical directions of the inner tube 3.

A spring 9 is inserted between the end of each support bar 6 remote from the outer cutter 5 and the bottom of the slot 7 for normally urging that end of the support bar 6 radially outwardly away from the central axis of the inner tube 3. Thus, the outer cutters 5 are normally biased by the springs 9 to be brought radially inwardly toward each other. The outer tube 2 can be axially moved with respect to the inner tube 3 to cause a lower end **2*a* (lower end in FIG. 1) to engage and displace tapered outer surfaces 6*a* of the support bars 6 remote from the outer cutters 5 in a radially inward direction against the resiliency of the springs 9, so that the outer cutters 5 can be maintained radially outwardly beyond the outside diameter of the drill pipe 1. When the outer tube 2 is moved upwardly toward the ground surface with respect to the inner tube 3, the lower end 2*a* of the outer tube 2 disengages from the tapered surfaces 6*a* of the support bars 6, whereupon the ends of the support bars 6 remote from the outer cutters 5 will be pushed radially outwardly under the resiliency of the springs 9 to bring the outer cutters 5 radially inwardly within the inside diameter of the drill pipe 1**.

Locking members 10 are accommodated in recesses defined in an outer circumferential surface of the inner tube 3 axially upwardly of the lower end thereof. Each locking member 10 has a portion extending in a circumferential direction of the inner tube 3 and projecting radially outwardly of the inner tube 3 by the resiliency of a spring (not shown). The outer tube 2 has locking member control windows 11 radially corresponding in position to the locking members 10, respectively. When the outer cutters 5 project beyond the lower end of the drill pipe 1 and are retained by the lower end **2*a* of the outer tube 2 with portions of the outer cutters 5 projecting radially outwardly beyond the outside diameter of the drill pipe 1, the locking members 10 project partly through the locking member control windows 11 radially outwardly. The drill pipe 1 has recesses 12 receptive therein of the portions of the locking members 10 projecting through the locking member control windows 11 to engage the locking members 10 lockingly against relative movement in the axial and circumferential directions of the drill pipe 1. When the locking members 10 are locked in the recesses 12, the inner tube 3 is fixed to the drill pipe 1 for rotation and axial movement therewith. Upon movement of the outer tube 2 upwardly or toward the ground surface to disengage the lower end 2*a* thereof from the ends of the support bars 6 and to displace the outer cutters 5 radially inwardly into the drill pipe 1, the projecting portions of the locking members 10 are progressively pressed by edges of the locking member control windows 11 into the outer tube 2 until the locking members 10 are retained within the outer tube 2** by the inner surface thereof.

Figure 2:
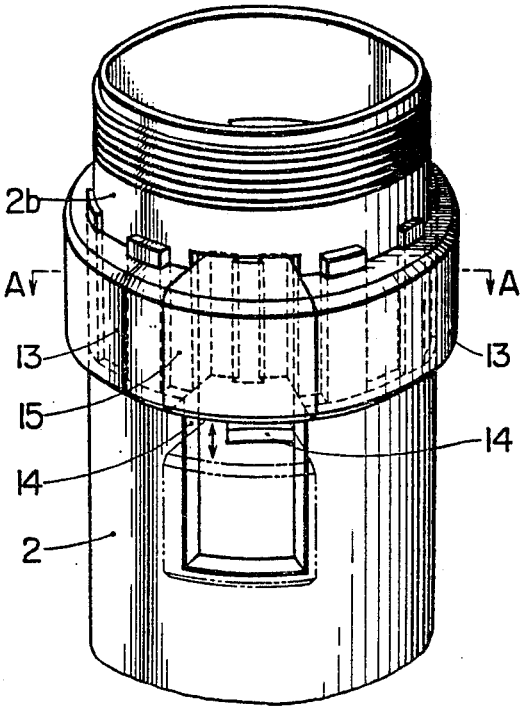
FIG. 2 is an enlarged perspective view of water stops, one of locking members, and one of water passage holes in the boring apparatus shown in FIG. 1.
Figure 3:
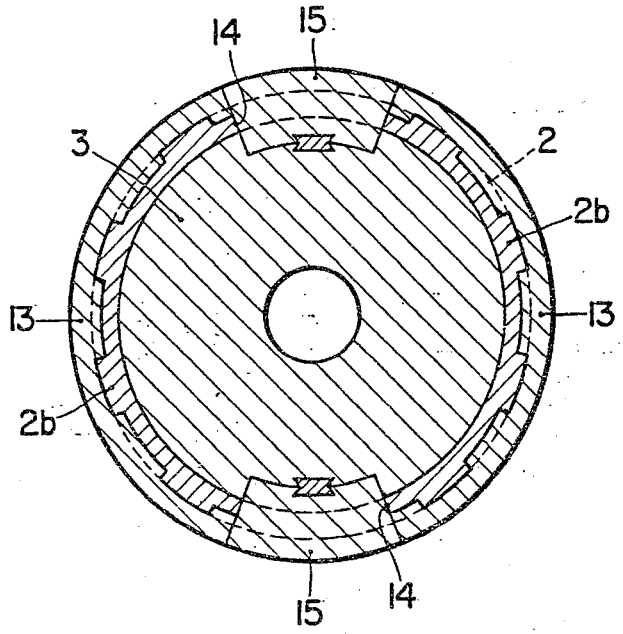
FIG. 3 is a cross-sectional view taken along line A—A of FIG. 2.
Figure 4:
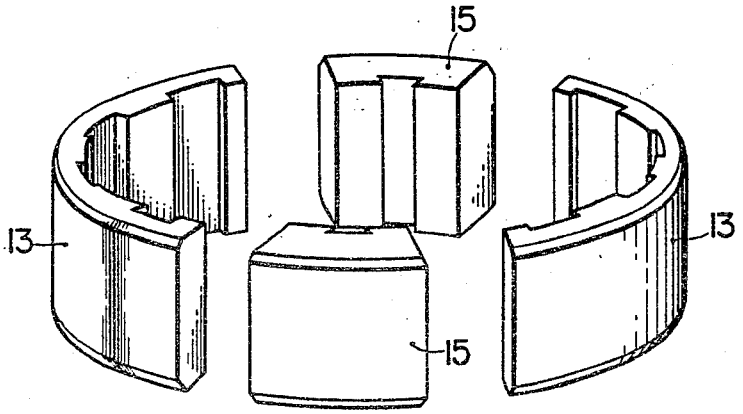
FIG. 4 is an exploded perspective view of the water stops and locking members shown in FIGS. 2 and 3.

The inner tube 3 has an upper end (upper end in FIG. 1) closer to the ground surface disposed below an upper end of the outer tube 2. The outer tube 2 has an upper end portion **2*b* which can be displaced into or out of overlapping relation to the upper end of the inner tube 3 when the outer tube 2 and the inner tube 3 are axially moved relatively to each other. As shown in FIGS. 2 and 3, a pair of water stops 13, each in the form of an arcuate member of an about 140° arc, are mounted in diametrically opposite relation on the upper end portion 2*b* of the outer tube 2. The water stops 13 are splined to the outer tube 2 so that the water stops 13 will be prevented from moving circumferentially around the outer tube 2. The outer tube 2 has water passage holes 14 extending radially through its wall and axially from a position between the water stops 13 to a position in which the outer and inner tubes 2, 3** are overlapped at all times.

A pair of diametrically opposite engagement members 15 (FIG. 3) are attached by wedges to the inner tube 3 against movement in the circumferential direction of the outer tube 2. The engagement members 15 project radially outwardly through the water passage holes 14, respectively. The water stops 13 and the engagement members 15 as combined jointly constitute a closed annular body.

The outer tube 2 and the water stops 13 are connected by splines on the outer tube 2 which are slightly longer than the axial length of the water stops 13. The water stops 13 are slightly axially movable with respect to the outer tube 2. The engagement members 15 are also slightly axially movable with respect to the inner tube 3 along the wedges.

When the outer tube 2 is moved to a position in which the locking members 10 are engaged in the recesses 12 in the drill pipe 1 and the outer cutters 5 project radially outwardly beyond the outside diameter of the drill pipe 1, the water stops 13 and the engagement members 15 are positioned in circumferential alignment with each other to jointly constitute the annular body. The annular body has an end face directed toward the bottom of the bore being drilled and held in abutment against an annular step 16 of which defined on an inner surface of the drill pipe 1 and directed toward the ground surface. The water stops 13 and the engagement members 15 cooperate with the annular step 16 in closing off any clearance between the outer tube 2 and the drill pipe 1 for thereby preventing water which flows through the drill pipe 1 from the ground surface from being introduced between the outer tube 2 and the drill pipe 1 toward the lower end of the drill pipe 1. The engagement members 15 and the annular step 16 serve as a stop to stop the inner tube 3 in a position in which the locking members 10 are aligned with but not engaged in the recesses 12 when the outer and inner tubes 2, 3 are inserted through the drill pipe 1 from the ground surface to the underground.

The outer tube 2 has in its upper end a water inlet port 17 communicating with the interior of the inner tube 3. Water is introduced through the water inlet port 17 through the inner tube 3 and supplied through the lower end of the inner tube 3 to the inner cutter 4 and the outer cutter 5.

The outer tube 2 has on its upper end a conically shaped projection 18 projecting toward the ground surface.

The cutter holder, which is composed of the outer tube 2 and the inner tube 3, will be inserted into the drill pipe 1 as follows: The outer tube 2 is moved toward the upper end with respect to the inner tube 3 so that the outer cutter 5 can be inserted into the drill pipe 1. With the locking members 10 held within the outer tube 2, the cutter holder is inserted into the drill pipe 1 from its end on the ground surface. The cutter holder is then delivered to the underground end of the drill pipe 1 by water under pressure which is supplied into the drill pipe 1 above the cutter holder inserted. When the inner tube 3 reaches the underground end of the dril pipe 1, the engagement members 15 are held against the annular step 16 and are locked in position. Then, the outer tube 2 is moved toward the underground end under inertia and water pressure to cause the outer cutters 5 to spread out beyond the lower end of the drill pipe 1 and also cause the locking members 10 to engage in the recesses 12, thereby joining the drill pipe 1 and the inner tube 3 together. The water stops 13 mounted on the outer tube 2 also abut against the annular step 16 and cooperate with the engagement members 15 in forming the annular body, which prevents water from flowing between the outer tube 2 and the drill pipe 1 toward the lower end of the drill pipe 1. The water then is forced to flow through the water inlet port 17 and the inner tube 3 toward the inner cutter 4 and the outer cutters 5. The drill pipe 1 is now driven to rotate and pushed into the ground by a drive means on the ground for drilling an underground hole.

The speed of advancing movement of the drill pipe 1 becomes slower as the cutting edges of the inner cutter 4 and outer cutters 5 are worn. When the inner cutter 4 or the outer cutters 5 thus worn are to be replaced, a wire with a hook attached to one end thereof is inserted through the drill pipe 1 and forced down with a stream of water until the hook engages the conical projection 18 on the upper end of the outer tube 2. The inner and outer tubes 3, 2 are then lifted up toward the ground surface by the wire. More specifically, the outer tube 2 is first moved upwardly by the wire with respect to the inner tube 3 as shown in the left half of FIG. 1. Such upward movement of the outer tube 2 enables the outer cutters 5 to be retracted within the inside diameter of the outer tube 2 and the locking members 10 to be pushed by the locking member control windows 11 radially inwardly into the outer tube 2, whereupon the inner tube 3 is disengaged from the drill pipe 1. At the same time, the water stops 13 are moved toward the ground surface with respect to the engagement members 15 as shown in the left half of FIG. 1 and in FIG. 2, allowing the water to pass downwardly between the outer tube 2 and the drill pipe 1. With the water thus flowing down through the inner tube 3 and between the outer tube 2 and the drill pipe 1, the inner and outer tubes 3, 2 can then lifted up by the wire with ease as they are subjected to a smaller load of water.

The water stops 13 and the engagement members 15 may be affixed to the outer tube 2 and the inner tube 3, respectively, against axial displacement, provided the water stops 13 and the engagement members 15 can be pressed against the annular step 16 on the drill pipe 1 at a position in which the locking members 10 are engaged in the recesses 12 in the drill pipe 1. There is a tendency, however, for the edges of the locking member control windows 11 to bite into the locking members 10 due to wear in use, and hence the locking members 10 becomes less smooth in projecting through the outer tube 2. To cope with such a difficulty, the water stops 13 and the engagement members 15 are preferably be axially movable as shown to facilitate unlocking by through up and down wobbling movement of the drill pipe 1 or to accept dimensional tolerances.

The water passage holes 14 may extend upwardly beyond the water stops 13 into communication with the interior of the inner tube 3 so that the water passage holes 14 can serve as water inlet ports instead of water inlet port 17.

With the boring apparatus according to the present invention, the outer cutters 5 are disposed more underground than the inner cutter 4, and hence there is no necessity for providing in the inner tube 3 or shank for the inner cutter 4 housing regions which would otherwise be required for the outer cutters 5 if the latter were positioned closer than the inner cutter 4 to the ground surface. Therefore, the holder for the inner cutter 4 is of a larger diameter and rugged construction, and the outer cutters 5 are larger in size as they can be accommodated in a large space within the drill pipe 1 in which there is no obstruction radially inwardly. The larger outer cutters 5 can cut a cylindrical bore 19 (FIG. 1) at a greater peripheral speed than that of the inner cutter 4. A central core 20 of a smaller diameter left in the bore 19 can be cut away and crushed by the inner cutter 4. The boring apparatus according to the present invention can drill underground holes more efficiently than conventional three corn rock bit.

The annular step 16 provided on the inner surface of the drill pipe 1 to prevent passage of water between the drill pipe 1 and the outer tube 2 contributes to a stopper step for preventing the inner tube 3 from dropping out through the lower end of the drill pipe 1. The boring apparatus of the invention is therefore of a simpler construction as the drill pipe 1 has no separate steps for preventing water passage and drop-out of the inner tube which would be required by known boring apparatus.

Although a certain preferred embodiment has been shown and described, it should be understood that many changes and modifications may be made therein without departing from the scope of the appended claims.

I claim:

1. A boring apparatus comprising:

a drill pipe for being placed underground;

an outer tube insertable into said drill pipe;

an inner tube axially movably inserted in said outer tube;

means for locking said inner tube at a lower end of said drill pipe against relative axial and rotative movement with respect to said drill pipe, thereby causing said inner tube to rotate with said drill pipe;

an inner cutter and outer cutters mounted on a lower end of said inner tube and projectable from said lower end of said drill pipe, said outer cutters being positionable axially further from said drill pipe than said inner cutter; and holding means mounting said outer cutters on said inner tube and including biasing means to cause portions of the outer cutters to project radially outwardly of a circumferential surface of said drill pipe.

2. A boring apparatus according to claim 1, wherein said locking means comprises locking members mounted on said inner tube, locking member control windows defined in said outer tube, and recesses defined in an inner surface of said drill pipe for receiving portions of said locking members as the locking members project through said locking member control windows.

3. A boring apparatus according to claim 1 or 2, wherein said holding means comprises pins mounted on said inner tube and extending in directions normal to a central axis of said drill pipe, support bars pivotably mounted on said pins, respectively, and supporting said outer cutters, respectively, said support bars having tapered surfaces engageable with a lower end of said outer tube when the outer tube is displaced axially of said inner tube so that ends of said support bars remote from said outer cutters will be moved toward said central axis of said drill pipe, and springs for urging the ends of said support bars remote from said outer cutters in a direction radially outwardly of the central axis when said inner tube is unlocked from said drill pipe.

4. A boring apparatus according to claim 1, further including means for blocking water from flowing between a cutter holder and said drill pipe, said blocking means comprising a water inlet port defined in an upper end of said outer tube and communicating with the interior of said inner tube, water stops mounted on an upper end portion of said outer tube and having radially outward arcuate surfaces lying radially outwardly of an outer circumference of said outer tube, said water stops being nonrotatable with respect to said outer tube, water passage holes defined in said outer tube and extending from a position between said water stops toward said lower end of said outer tube, said water passage holes providing communication between the exterior and interior of said outer tube, engagement members mounted nonrotatably on said inner tube and projecting through said water passage holes radially outwardly of said outer tube, said engagement members and said water stops being combinable into an annular body, and an annular step defined on an inner surface of said drill pipe and engageable with said annular body when said inner tube and said drill pipe are locked by said locking means.

5. A boring apparatus according to claim 4, wherein said water stops are slightly axially movable with respect to said outer tube, and said engagement members are slightly axially movable with respect to said inner tube.

6. A boring apparatus comprising:

a drill pipe for being placed underground;

an outer tube insertable into said drill pipe;

an inner tube axially movably inserted in said outer tubes;

means for locking said inner tube at a lower end of said drill pipe against relative axial and rotative movement with respect to said drill pipe, thereby causing said inner tube to rotate with said drill pipe;

an inner cutter and outer cutters mounted on a lower end of said inner tube and projectable from said lower end of said drill pipe;

holding means mounting said outer cutters on said inner tube and including biasing means to cause portions of the outer cutters to project radially outwardly of a circumferential surface of said drill pipe;

arcuate water stops nonrotatably mounted on an upper end portion of said outer tube and having radially outward arcuate surfaces lying radially outwardly of an outer circumference of said outer tube, said outer tube having on an upper end thereof a water inlet port communicating with the interior of said inner tube, and water passage holes extending between a position between said water stops toward the lower end of said outer tube;

said locking means including locking members mounted on said inner tube and recesses defined in an inner surface of said drill pipe for receiving portions of said locking members, respectively; and engagement members nonrotatably mounted on said inner tube and projecting through said water passage holes radially outwardly of the outer circumference of said outer tube, said engagement members and said water stops being combinable into an annular body, said drill pipe having on an inner surface thereof an annular step directed toward a ground surface and engageable with said annular body when said locking members are engaged in said recesses, respectively.

7. A boring apparatus comprising:

a drill pipe for being placed underground;

an outer tube insertable into said drill pipe;

an inner tube axially movably inserted in said outer tube;

means for locking said inner tube at a lower end of said drill pipe against relative axial and rotative movement with respect to said drill pipe, thereby causing said inner tube to rotate with said drill pipe;

an inner cutter and outer cutters mounted on a lower end of said inner tube and projectable from said lower end of said drill pipe;

holding means mounting said outer cutters to cause portions of the outer cutters to turn and project radially outwardly of a circumferential surface of said drill pipe;

said holding means including pins mounted on said inner tube, support bars pivotably mounted on said pins and supporting said outer cutters on one ends of said support bars, respectively, said support bars having tapered surfaces remote from said one ends, and springs acting between said inner tube and said support bars for urging the other ends of said support bars away from a central axis of said drill pipe, whereby when said inner tube is locked against movement with respect to said drill pipe, said outer tube has a lower end engaging said tapered surfaces to displace said other ends of said support bars radially inwardly toward said central axis of said drill pipe, and when said inner tube is unlocked from said drill pipe, said other ends of said support bars are displaced under the resiliency of said springs in a direction away from said central axis.

* * * * *